United States Patent [19]

Higgs

[11] 4,000,533

[45] * Jan. 4, 1977

[54] ANCHORING DEVICE FOR BUOYANT LIFE SAVING EQUIPMENT

[75] Inventor: William York Higgs, Gibsons, Canada

[73] Assignee: Intercontinental Marine Limited, Vancouver, Canada

[ * ] Notice: The portion of the term of this patent subsequent to Nov. 28, 1989, has been disclaimed.

[22] Filed: Aug. 12, 1974

[21] Appl. No.: 496,711

Related U.S. Application Data

[63] Continuation-in-part of Ser. No. 465,661, April 30, 1974, Pat. No. 3,905,060, which is a continuation of Ser. No. 280,418, Aug. 14, 1972, abandoned, which is a continuation-in-part of Ser. No. 47,312, June 18, 1970, Pat. No. 3,703,736.

[30] Foreign Application Priority Data

Apr. 22, 1974 United Kingdom ..... 17516/74

[52] U.S. Cl. ..... 9/9; 9/14

[51] Int. Cl.[2] ..... B63C 9/22

[58] Field of Search ..... 9/8 R, 8.3 E, 14, 9; 114/230

[56] References Cited

UNITED STATES PATENTS

| | | | |
|---|---|---|---|
| 665,240 | 1/1901 | Liuonius | 9/14 |
| 3,618,150 | 11/1971 | Anselmi | 9/8.3 E |
| 3,754,291 | 8/1973 | Harris et al. | 9/14 |

*Primary Examiner*—Trygve M. Blix
*Assistant Examiner*—Gregory W. O'Connor
*Attorney, Agent, or Firm*—Stevens, Davis, Miller & Mosher

[57] ABSTRACT

A life saving device for vessels which provides anchorage for buoyant equipment such as life rafts or life boats, in the form of a buoy releasably carried by a vessel in a manner so as to float free if the vessel sinks, while remaining attached to the vessel by a cable held on a reel on the buoy and having its outer end connected to the vessel. The buoy carries a lifeboat mooring line for life boats or life rafts to secure themselves to the buoy, this lifeboat mooring line being buoyant and being relatively long compared to the largest dimension of the buoy. The lifeboat mooring line is normally stowed on or in the buoy and arranged to be automatically released after the buoy has separated from the vessel, and preferably a delayed action release mechanism is provided which ensures that the lifeboat mooring line is not released until the buoy has cleared the vessel's rigging so that the mooring line cannot become entangled with any part of the vessel. The release mechanism may include a rip cord which releases the lifeboat mooring line from the stowed position when fully extended, the rip cord having a stowed length of say fifty feet. The lifeboat mooring line is preferably held in a recess in the buoy, and protected from the weather by a cover which is automatically opened to release the mooring line at a suitable moment.

26 Claims, 19 Drawing Figures

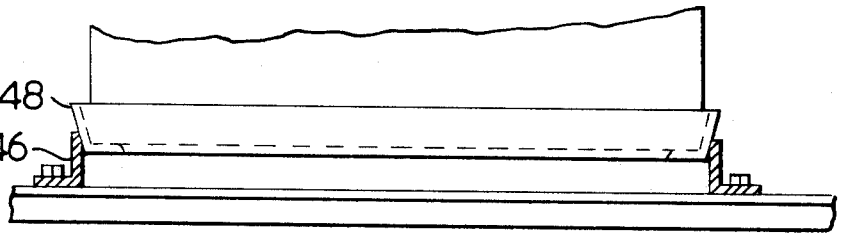
FIG.8
FIG.9
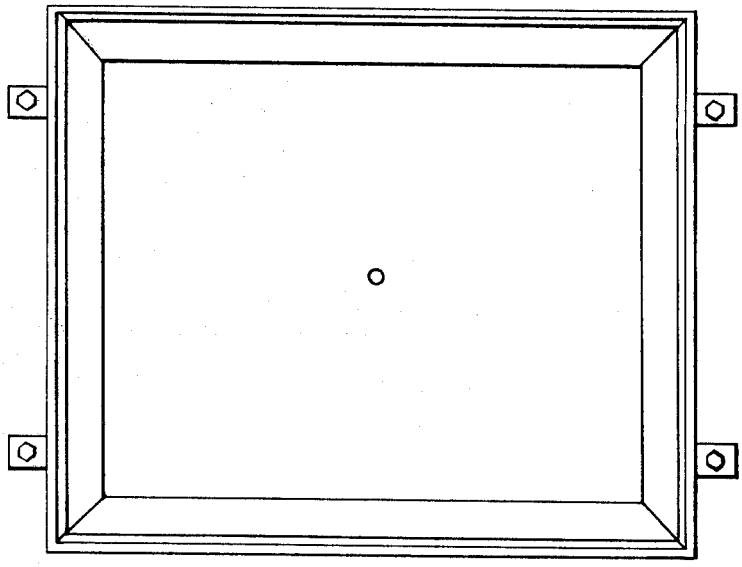

ANCHORING DEVICE FOR BUOYANT LIFE SAVING EQUIPMENT

This application is a continuation in part of my copending patent application Ser. No. 465,661 filed Apr. 30, 1974, now U.S. Pat. No. 3,905,060 which is a continuation of patent application Ser. No. 280,418 filed Aug. 14, 1972, now abandoned which is itself a continuation-in-part of my application No. 47,312 filed on June 18, 1970, and which issued as U.S. Pat. No. 3,703,736.

This invention relates to an anchoring device for buoyant life saving equipment.

The general use of small steel hulled vessels such as tugs and trawlers has created a serious hazard because of the instant sinking characteristics of these vessels. Suddenly, and perhaps at night, the crew find themselves in the water. Typically, there has been no time to send a distress call. The buoyant life saving equipment becomes scattered, overturned or broken up, as is shown by the fact that there are numerous examples of boats, life rafts and other buoyant equipment being recovered either damaged or intact, but empty. Under the above conditions, the chances of the crew for survival are small. In the case of passenger vessels the foregoing condition is greatly magnified.

If the wind is on-shore, conditions are rough and the coast is steep and untenable as is the case in many areas on the west coast of Vancouver Island and elsewhere, the survivors face almost certain destruction in rafts which cannot be kept off shore under such conditions.

If the wind is off-shore, survivors drift out to the ocean. Survivors drifting to sea on a raft or on any buoyant equipment make a very hard mark to pick up in the ocean even with excellent rescue services. Only too often death from exposure, fatigue, lack of nourishment and cold occurs before the survivors are located. The personal experience of the inventor in conducting searches on behalf of underwriters and owners indicates that the scattering of survivors is one of the greatest causes of loss of life at sea.

The invention of my application Ser. No. 47,312 (now U.S. Pat. No. 3,703,736) is based on the idea of using the wreck as an anchoring device for the buoyant life saving equipment. A buoy is connected to the vessel by an anchoring cable. This cable is wound on a cable reel rotatably mounted on the vessel or the buoy and arranged to permit the buoy to remain on the surface while maintaining an anchoring connection between the buoy and the vessel. Mooring means is provided on the buoy so that the buoyant life saving equipment can be secured to it. Preferably a light and radio beacons are automatically actuated upon the release of the buoy from the vessel. A radar reflector can also be included. An important feature of my aforesaid patent was the provision of at least one buoyant lifeboat mooring line or rope which trails out from the buoy to facilitate survivors establishing contact with it, and for attachment of buoyant equipment to the buoy while allowing this to remain at a distance from the buoy which enables the buoyant equipment to whether a storm more safely than if closely connected to the buoy. This lifeboat mooring line is long relative to the size of the buoy, being normally stowed with the buoy in such manner as to be released automatically from the stowed position when the buoy separates from the vessel to allow the line to stream out on the water.

With the use of the buoy as described, when there is an instant sinking the light on the buoy will provide a rallying point. This is important because of the confusion at such times. If a survivor has been able to reach a raft or boat he can moor it directly to the buoy or to the lifeboat mooring line or lines. Survivors who have not reached a raft or boat can hold on to the floating mooring line on the buoy or a lifeline around the buoy until one of the others can bring a raft or boat to such survivors. The lifeboat mooring line will trail out and assist survivors in reaching the buoy. All buoyant equipment may secure to the lifeboat mooring line or to the other mooring means on the buoy; however it will be understood that mooring of boats to a floating line is much easier in rough weather than mooring directly to a bobbing buoy.

The survivors on buoyant equipment moored to the buoy which is in turn anchored to the wreck will be in a permanent and collected position where they can readily be located by rescuers. They will not be driven out to sea or on to inhospitable shores at the whim of the wind and the seas. Fatigue and exposure to the elements will be minimized. The radar reflector, light and radio beacons will assist speedy rescue. Furthermore, the anchored buoy will have a sea anchor effect in heavy weather, which is highly beneficial, minimizing the chance of swamping or upset.

Applicant is now aware of two patents, namely U.S. Pat. No. 1,091,860 to Miner, and U.S. Pat. No. 1,414,273 to Gwynn, each of which show a buoy releasably mounted on a vessel and which remains connected to the vessel when this sinks by a cable carried by a reel on the buoy. The buoys shown in these prior patents include short ropes attached to the buoy and suitable for being grasped by swimmers in the water. The Gwynn patent mentions that life saving apparatus may be attached to the ropes, but this apparently refers to the life-rings shown by Gwynn, rather than life boats or life rafts. The ropes shown in these patents ar so short that mooring of life boats or life rafts thereto would be very difficult or impossible in stormy conditions or high waves in a gale, under which conditions most sinkings and other forms of marine disasters generally occur. The ropes shown in these patents are shorter than the largest dimensions of the buoys, and presumably as a consequence of this no special stowing arrangements are suggested, although it would seem that on certain types of vessels even short loose ropes such as shown in these patents would present the danger of entaglement with vessel's rigging and so render the buoy unreliable.

The apparatus of this invention (as of my prior U.S. Pat. No. 3,703,736) provides a lifeboat mooring line or lines very much longer than the short ropes shown in the Miner and Gwynn patents, at least several times longer and preferably many times longer, than the largest dimension of the buoy. In practice, a lifeboat mooring line of about 25 feet is used in the smallest model of buoy (which is about 15 inches high and 24 inches in diameter), whereas with a buoy having a maximum dimension of about 53 inches a lifeboat mooring line of about 50 to 250 feet is used; i.e. the length of the mooring line is in each case at least ten times, and preferably at least fifteen times, greater than the maximum dimension of the buoy. The relatively long lines not only allow these to stream out if the water, for ready attachment of the buoyant equipment thereto; but the length has an important effect on the manner in which buoyant equipment connected thereto can weather a storm. In fact, the combination of the anchoring cable which hangs in a catenary between the buoy and the sunken vessel, the buoy itself, and the relatively long lifeboat mooring line provide a very efficient elastic type of system for allowing buoyant equipment to weather a storm without jerking, and one which is not suggested by the Gwynn or Miner patents.

Thus, an important feature of this invention is the combination of the sunken vessel which provides an anchor point, the anchoring cable connecting the vessel to the buoy, and the buoy with buoyant equipment connected thereto by the lifeboat mooring line and their painters and which allows all buoyant equipment to ride independently and far enough apart so that the buoyant equipment will not collide each with the other and so they can all ride freely up and down with the waves in a storm. None of this equipment, the buoy anchoring cable, buoy, lifeboat mooring line, buoyant equipment or their painters will be subject to wear, surge or shock riding in this manner in heavy weather. Furthermore, if stong wave action or wind gusts should tend to pull the buoyant equipment and the buoy strongly away from the vessel to which the buoy remains anchored, such movement can be accommodated by temporary submergence of the buoy without this causing any appreciable downwards pull on the buoyant equipment. Such movement thus provides another degree of "give" in the holding of the buoyant equipment, which is augmented by the amount of stretch available in the relatively long length of lifeboat mooring line, and which reduces the risk of swamping of the buoyant equipment. A lifeboat mooring line of polypropylene of about 50 feet in length can stretch by 1 foot.

A further feature of my aforesaid U.S. Pat. No. 3,703,736 was the provision for stowing the lifeboat mooring line so that it does not become entangled in the vessel's rigging when the buoy is released from the vessel. As described, the lifeboat mooring line has an inner end fixed to the mooring rail of the buoy, and is normally stowed in place on the buoy. A rip cord is also stowed on the buoy, and is connected to a support which carries the buoy and which is fixed to the deck of the vessel. On release of the buoy from the support, for example when the buoy is launched or when the vessel suddenly sinks, the rip cord causes the buoyant mooring line to be released so that this streams out downwind of the buoy.

This application is concerned with buoys similar to that described in U.S. Pat. No. 3,703,736 but includes various modifications. One modification, fully described in co-pending application Ser. No. 280,418, relates to the mounting arrangement of the anchoring cable reel, this being mounted in the lower part of the buoy and surrounded by support means for the buoy. The present application is however principally concerned with improved arrangements for stowing the lifeboat mooring line which have as one object to provide for protection of the stowed line from the weather, and, as another object, to provide means interconnecting the buoy and the vessel and arranged to release the lifeboat mooring line only when the buoy has separated from the vessel by a predetermined amount. Such delayed action release mechanisms ensure that the lifeboat mooring line is not released from the buoy until the latter is clear of the vessel's rigging.

One form of delayed action release mechanism may be means interconnecting the buoy and the vessel and including normally stowed release means which cause release of the mooring line when pulled out to the full length of the release means. One form of release means is a rip cord arranged for connection with the vessel and operable to release the life boat mooring line when fully extended. The rip cord has a normally stowed length at least comparable to the height of the uppermost rigging of the vessel above the position where the buoy normally rests, and is stowed in such manner as to be capable of being pulled from the stowed position and fully extended before the mooring line is released, whereby the possibility of entaglement of the mooring line on the rigging is avoided. The stowed length of the rip cord will of course vary with the nature of the vessel and the positioning of the buoy, but the various models of buoys will be supplied with standard lengths of rip cord which can be cut off to shorter lengths on installation of the buoy on the ship. The minimum length of rip cord normally supplied would be at least 50 feet for vessels such as tugs, the preferred length being 100 feet.

The release means may alternatively be a release line normally stowed on a small reel with its inner end attached to the small reel, and with its outer end arranged to be wound upon an auxillary reel rotatable with the main reel carrying the anchoring cable, so as to be pulled taut after a predetermined amount of anchoring cable has paid out.

The lifeboat mooring line may be held in stowed position by holding means such as breakable cord means, the rip cord being arranged to cause breakage of these cord means either by forces applied to the cord means directly by the rip cord, or by tension applied to the outer end of the lifeboat mooring line. In the latter case, the rip cord is itself breakable but substantially stronger than the breakable cord means so that the lifeboat mooring line is fully released from the cord means before the rip cord breaks.

The main length of the rip cord may be stowed either on the buoy, as described in my aforesaid Pat. No. 3,703,736, or may be stowed on the vessel. In the latter case, the rip cord is stowed so that it can be pulled out to its full length at substantially less than a predetermined tension, this predetermined tension being that required for releasing the lifeboat mooring line from the buoy. For this purpose, the rip cord may be carried by a small reel mounted on the vessel, from which the rip cord can be pulled at low tension compared to that required to release the lifeboat mooring line.

The lifeboat mooring line is preferably stowed in an enclosure formed at least partly by the buoy. The enclosure may be formed between the buoy and a support on which this rests, or may be formed by a recess in the buoy normally closed by a cover. Such recess is shaped and positioned so that when the buoy is floating the lifeboat mooring line is exposed to the water when the cover is opened, and so that the action of the water dislodges the mooring line and causes this to stream out on the water. The cover may be formed or ripable fabric or plastic connected by a rip cord to the vessel so that when the buoy has separated from the vessel by a predetermined amount the cover is ripped open to allow the lifeboat mooring line to float out on the water. In another arrangement the recess in the buoy houses an inflatable life raft, and is closed by a removable cover, and the means for releasing the mooring line are constituted by inflating means for the life raft. The inflating means may operate automatically after the buoy has separated from the vessel by a predetermined amount to cause inflation of the life raft which dislodges the cover, and expels the lifeboat mooring line to then stream out on the water; alternatively hand operated means may be used to actuate the inflating means as and when required.

The buoyant lifeboat mooring line may be made of buoyant material, or may be buoyant by virtue of floats attached thereto.

In the drawings, which illustrate preferred embodiments of this invention:

FIG. 8 is a detail elevation view illustrating the mounting for a buoy in accordance with this invention;

FIG. 9 is a plan view of the mounting FIG. 8;

Figure 1:
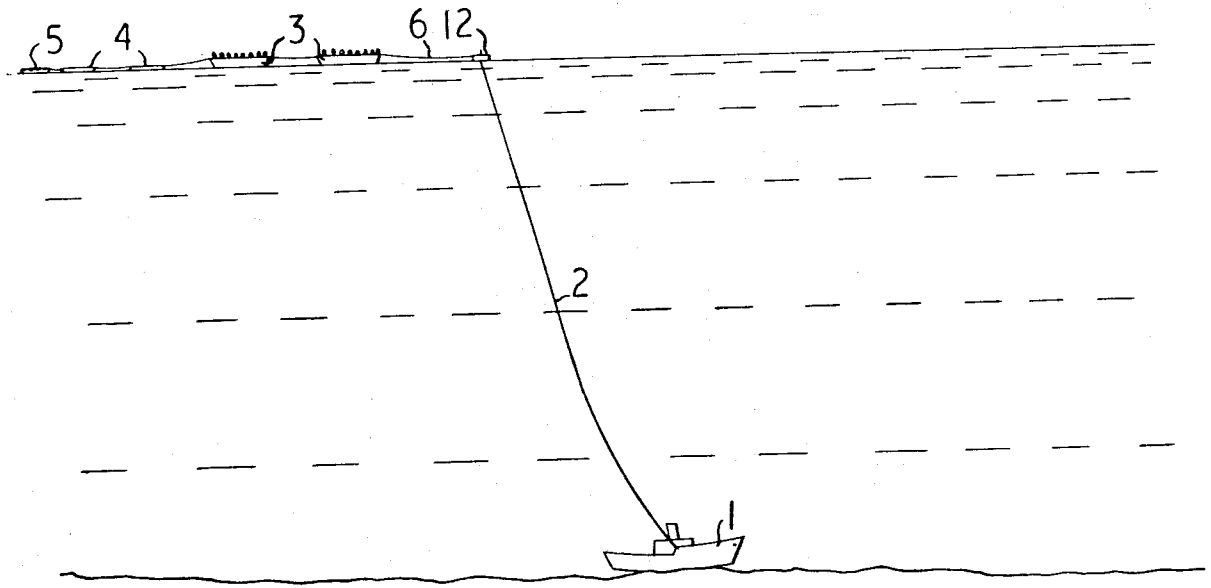
FIG. 1 is an elevation view showing a sunken vessel and illustrating the use of this invention for anchoring life saving equipment such sunken vessel.

Referring now to FIGS. 1 to 9 of the drawings, FIG. 1 illustrates a sunken vessel 1 which, through anchoring cable 2, acts as an anchor for buoy 12. Lifeboats 3, inflatable rafts 4 and raft 5 are secured by lifeboat mooring lines 6 to buoy 12. FIG. 1 illustrates the buoyant equipment secured to other items of buoyant equipment in a series and finally lifeboat 3 linked by line 6 to buoy 12. It will, however, be appreciated that each item of buoyant equipment 3, 4 and 5 can be connected directly to buoy 12.

From this description, it will be evident that the lifeboat mooring line 6 must be of adequate strength to hold a life raft or boat, and preferably several boats in position relative to the buoy, and from the drawing it is clear that line 6 is at least several times greater in length than the largest dimension of the buoy.

Figure 2:
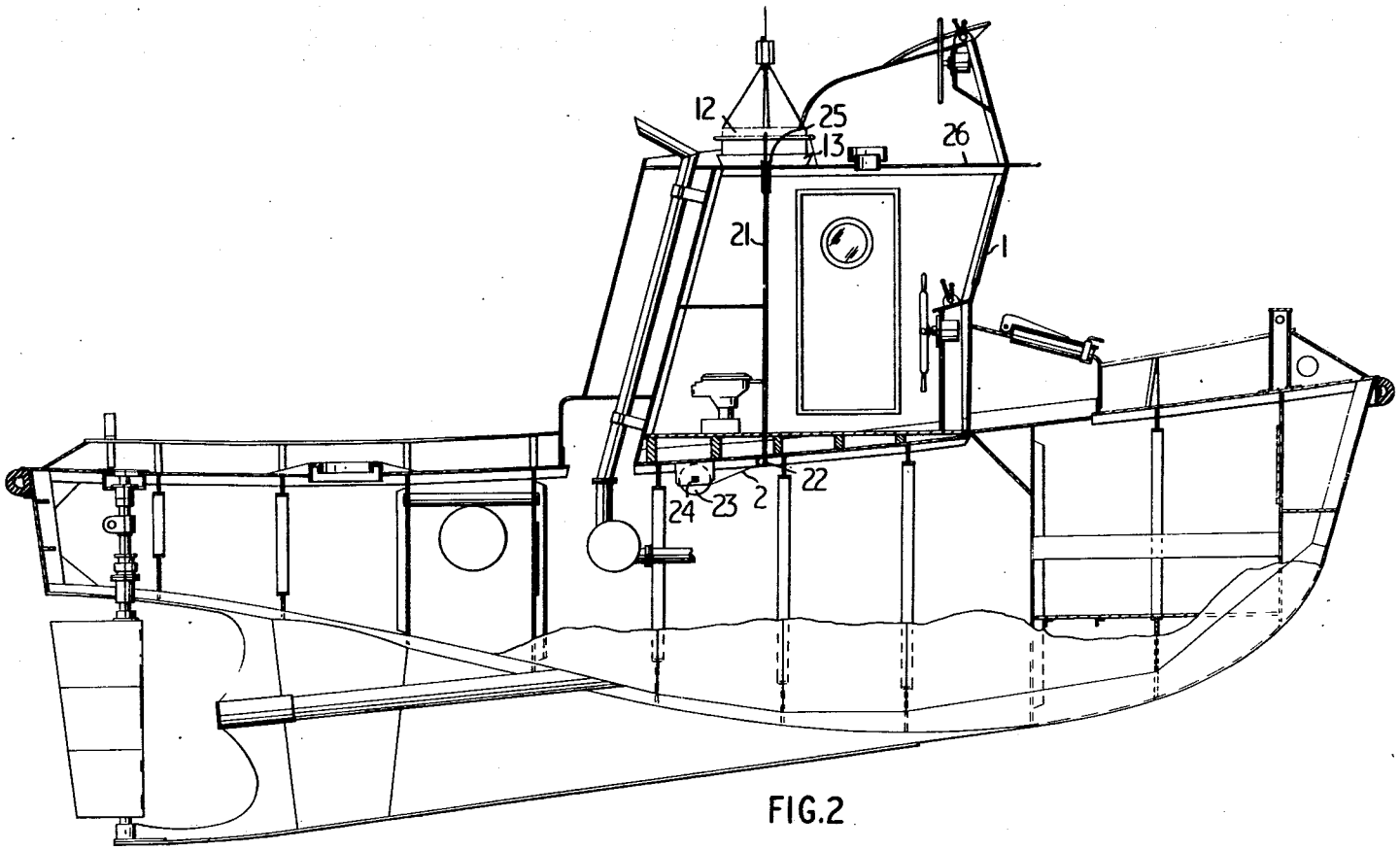
FIG. 2 is an elevation view of a tug upon which a life saving buoy in accordance with one form of this invention is mounted.

FIG. 2 illustrates a typical small steel tug boat of the type the rapid sinking of which has been responsible for the loss of many lives. The tug generally indicated at 1 has buoy 12 supported on rack 13 which is mounted on the wheel house. A conduit pipe 21 to house steel cable 2 leads from belled ferrule 25 on top of deck 26 to block 22. Ferrule 25 is positioned directly below the center of buoy 12. Cable 2 is secured to reel shaft 24, and spooled on reel drum 23. It goes over block 22 and up conduit 21, to pass through ferrule 25. Buoy 12 can be secured to rack 13 in the manner described below. The slack in cable 2 can be taken up on reel 23. Cable 2 is appropriately tensioned and a spring loaded brake on reel 23 is adjusted so as to be ready for operation. This brake is adjusted so that the buoy will freely pull the cable slack in a controlled manner.

Figure 3:
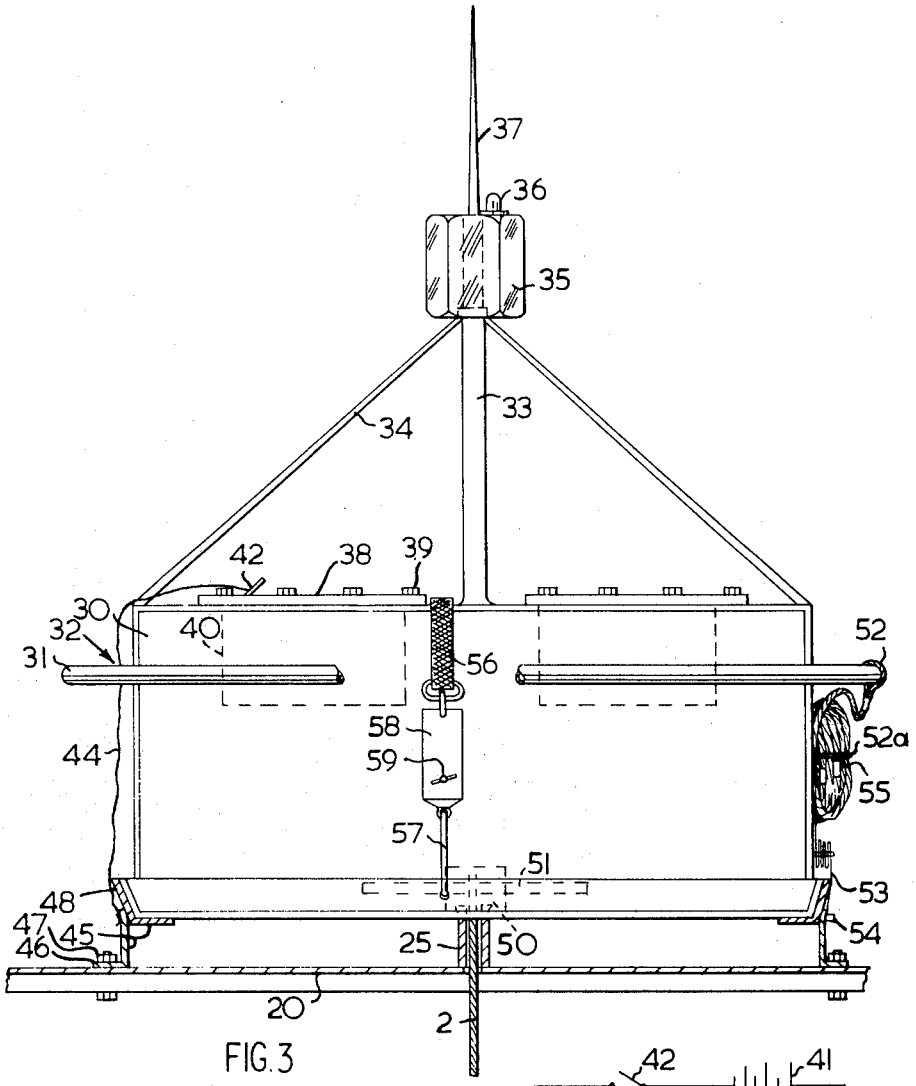
FIG. 3 is an elevation view of a buoy illustrating means for securing the buoy in position and a life boat mooring line.
Figure 4:
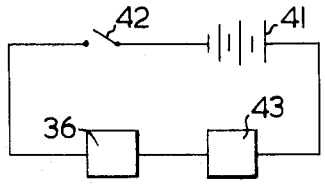
FIG. 4 shows an electrical circuit used.

FIG. 3 shows the buoy 12 in greater detail. The buoy has a main body portion 30 which is preferably mainly filled with sufficient cellular buoyant material to cause the buoy to float free form the sinking vessel. Body 30 may be square when considered in plan view or of any desired shape. A continuous mooring rail 31 encircles body 30 and is secured to it by supports 32. This mooring rail is of a substantial nature and of sufficient strength to moor the life boats and life rafts even under stormy conditions. On top of body 30 there is an upwardly extending duct 33 supported by stays 34. A reflector 35 and automatic light 36 and radio antenna 37 are located at the top of duct 33. Duct 33 provides a conduit for wires leading to light 36 and to radio antenna 37. A water tight hatch 38 is bolted in position by bolts 39 and leads to a space 40 for electrical equipment. Such equipment may be arranged in the simple circuit illustrated in FIG. 4 in which battery 41 is controlled by switch 42 and energizes light 36 and electronic signalling device 43. Signalling device 43 emits an emergency beep signal. As illustrated in FIG. 3 switch 42 can be a manual switch mounted on hatch 38 and connected by a break-away pull cord 44 to the supporting rack 45 for the buoy. Accordingly when the buoy is released from its supporting rack, switch 42 will automatically be closed so as to switch on the signal light and the electronic signalling device. In case of mechanical failure or if there is time to commence sending a signal before the ship sinks then switch 42 can be worked manually. However, preferred switch means, notably magnetic switches, are described below.

Rack 45 is mounted on angle steel lugs 46 which are bolted by bolts 47 to the top deck. Rack 45 has slanting sides 48 so that the buoy will not jam if the sinking ship lists.

There is a central recess 50 in the main body 30. Recess 50 is bridged by securing bar 51 to which line 2 is connected.

Belled ferrule 25 projects slightly into the securing recess 50 so that water coming down the deck or dripping off the underside of the buoy will not go down the conduit pipe. The belled end also avoids the cable chafing when the line is out.

In accordance with the invention at least one life boat mooring line 52 is provided having its inner end secured to rail 31 by means of a 3 foot length tagline of stainless steel which avoids any chafing between the main length of the line and the buoy. The main length of line 52 is coiled as shown, the outer end being free. The line 52 is held in the stowed position by a loop of breakable cord 52*a* which is a type of cord pre-tested to break at 10 pounds of tension. A rip cord 53 attached at 54 to rack 48 is provided for automatically releasing the lifeboat mooring line 52 by breaking cord 52*a*, this rip cord being cut to a desired length (say 50 feet) to delay deployment of the lifeboat mooring line until the buoy has separated from the vessel by an amount sufficient to be clear of all the vessel's rigging. The main length of the rip cord 53 is stowed on the buoy by being formed into several coils each tied to an eye on the buoy by a small loop of break away cord having a breaking strength of 5 pounds tension, and the outer end of the rip cord is secured to the loop of cord 52*a* in such a way as to break this cord when the rip cord has been fully extended. The rip cord itself has a strength considerably in excess of that of cord 52*a*, say 50 pounds tension. Thus, when the buoy separates from the vessel, the rip cord is gradually pulled free of the small loops of break away cords, and when fully extended the rip cord releases the lifeboat mooring line 52 onto the water.

The lifeboat mooring line 52 is of buoyant material, but is not easy for a swimmer to see and therefore floats 55 assist in making the position of the rope visible. Attachment of boats and buoyancies is also facilitated, and mooring line 52 is also provided with several eyes for this purpose.

In the case of some vessels and depending also on the design of the buoy and its location on the vessel, it may not be necessary to lash the buoy in place. It will remain in position on the rack and float free if the vessel sinks. It will, however, sometimes be desirable to avoid any possibility of the buoy becoming accidentally detached. Accordingly, a length of webbing 56 can be passed over the main body 30 of the buoy and secured to a hydrostatic release valve 58. Hydrostatic release valve 58 is shackled at 57 to the side 48 of the rack. This hydrostatic release may be of the Cory type or of any other standard design. When a predetermined depth such as ten or fifteen feet is reached the hydrostatic pressure of the water will cause the release to open so that the buoy will float free. If the hydrostatic release 58 does not include provision for manual release 59 then it is desirable to include also a manual release such as a senhouse slip which could conveniently be located on the side of body 30 opposite to the hydrostatic release.

Figure 5:
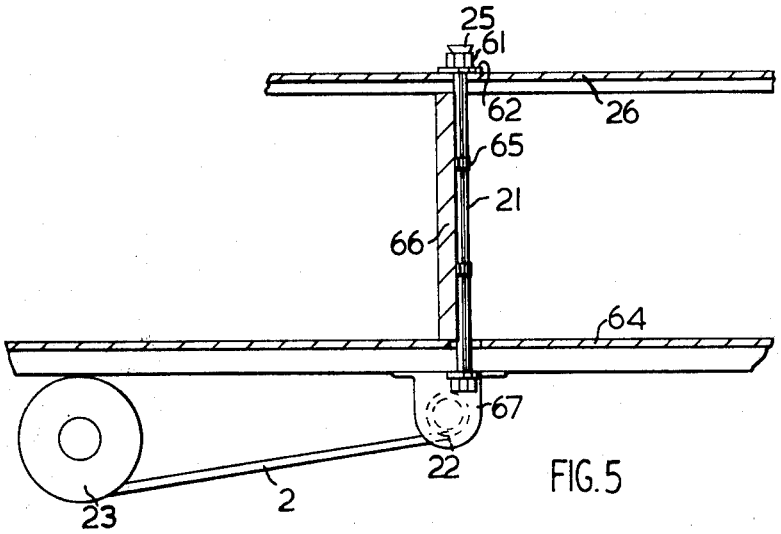
FIG. 5 is a detail elevation view illustrating the cable duct and reel.
Figure 6:
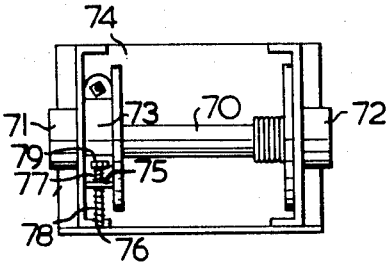
FIG. 6 is a detail side elevation view of the reel shown in FIG. 5.
Figure 7:
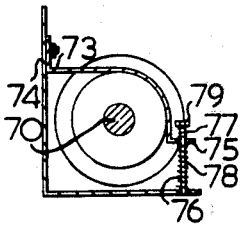
FIG. 7 is a detail end elevation view of the brake band shown in FIG. 6.

FIG. 5 illustrates in more detail duct 21 through which cable 2 passes, the ferrule 25, pulley 22, and reel 23. FIGS. 6 and 7 show more details of the reel and brake which controls the rate at which the cable 2 is paid out by the reel: these details, which are not central to the invention now claimed, are fully described in my issued U.S. Pat. No. 3,703,736.

Much of the loss of life at sea occurs near the coastline and on the continental shelves of all countries where the depth rarely exceeds 3,000 feet. A moderately sized buoy can lift this length of cable with good freeboard. The length of the cable and the size of the buoy will be calculated to conform to the class of ship on which it is to be used having regard to soundings in the geographical area for which the ship is designed and in which she customarily trades. Three thousand feet will be entirely adequate for a very high proportion of conditions.

Figure 10:
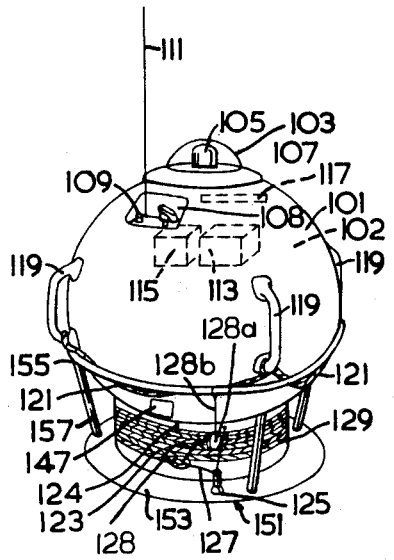
FIG. 10 is a perspective drawing of a second embodiment of the invention.
Figure 11:
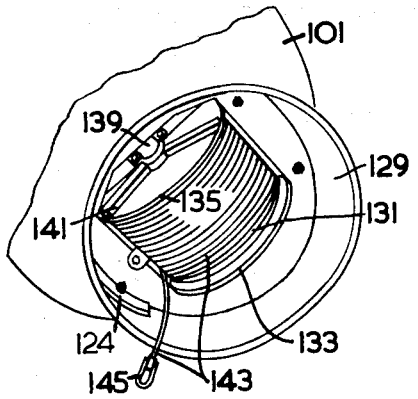
FIG. 11 is a perspective drawing of the underneath of the embodiment shown in FIG. 10.
Figure 12:
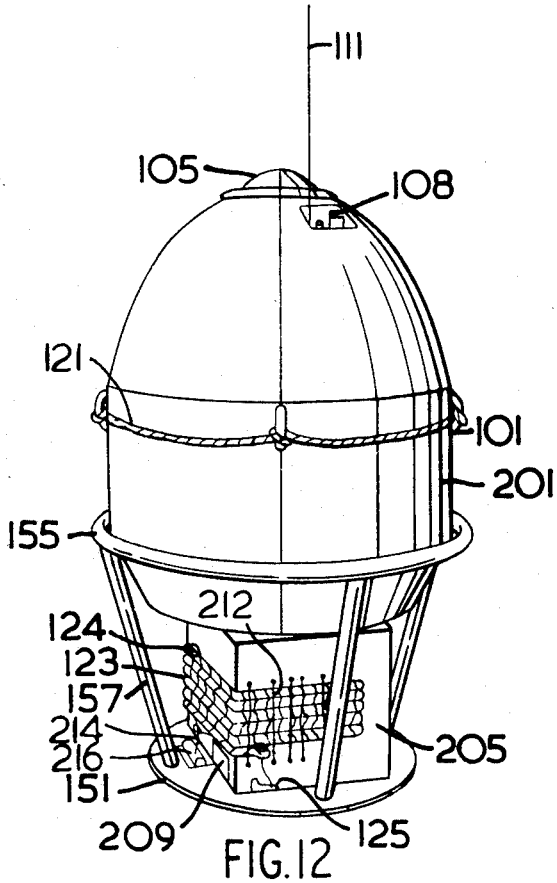
FIG. 12 is a perspective drawing of a third embodiment of the invention.

FIGS. 10 to 12 of the drawings show a modified form of buoy intended for use on relatively small vessels, i.e. vessels with a length of under 100 feet. The upper part of the buoy includes a buoyant element in the form of a part-spherical body 101 formed as a rigid shell of rugged, moulded fiberglass or other suitable material such as aluminum. The color of the buoy will be "International Orange", which renders the buoy clearly visible against the background of the sea. Body 101 is filled with a closed-pore foamed synthetic material 102 which provides buoyancy even if the body 101 is punctured or otherwise damaged. The material 102 provides flotation means of sufficient buoyancy to cause the buoy and parts carried by the buoy to float freely from a sinking vessel.

Mounted on the superstructure or top of the buoy body is a clear Lucite dome 103 covering a strobe light 105 of the high intensity Xenon type as used on aircraft for collision avoidance. The dome 103 co-operates with a cannister 107 to form a sealed enclosure for the light. The strobe light is connected to a solid state driving circuit which causes the light 105 to produce ten flashes per minute with a peak intensitiy of 1 million foot candles. By the use of Fresnel lens, the range of this light is between 15 and 25 miles under average conditions. On an upper part of body 101 is formed a recess 108 in which are disposed various control switches 109 and the base mounting of an omnidirectional antenna 111. These parts are all sealed against the ingress of water and moisture.

Inside the body, and indicated merely by dotted outlines, are a sealed enclosure 115, and a battery 113 of the alkaline manganese or lithium type, having a voltage of 13.5 and designed to have a shelf life of 2 ½ or 5 years. The sealed enclosure 115 contains the driving circuit for the strobe light and a radio transmitter. The battery is capable of operating the strobe light 105 and the radio transmitter for a period which depends on the expired shelf life of the battery, but in normal use will be between 140 hours and 192 hours. The radio transmitter is connected to the antenna 111 and when activated provides a distress and homing signal approved under international regulations.

The radio transmitter and strobe light are both connected to a magnetically operated switch within the body of the buoy. The switch is hermetically sealed against ingress of moisture, and is positioned to be externally operated by a magnet fixed to the upper rail of the seating mount to be described. The magnet normally holds the switch in the "off" position, but when the buoy is removed from the mount (either by being launched or floating free) the switch is separated from the magnet, and a spring force then moves the switch to the "on" position to activate the transmitter and strobe light.

Disposed in an upper part of the body 101 is a internal radar reflector 117 affording 360° coverage. Spaced round the periphery of the body 101 are four vertically extending case aluminum life line mooring and lifting lugs 119, streamlined to avoid entaglement with the vessel's rigging when the buoy floats free. These lugs are securely fixed to support plates inside the body, and arm loops 121 of polypropylene rope extend between these lugs 119. These loops of rope have steel cores and are strong enough to serve as temporary moorings. The loops for buoyant equipment are attached to the body of the buoy with rip-away tapes to lessen the chance of fouling on the vessel's equipment.

The body 101 is generally spherical in shape, but has fitted to its bottom a downward extension provided by a moulded fiberglass circular skirt 129 which has an open bottom. This can be seen clearly in FIG. 11, which also shows how the skirt 129 serves as a housing for the lower half of a cable reel 131 having two spaced end plates 133 and 135 connected by a shaft which extends into journal bearings 139 carried by the bottom of the body 101. The end plates 133 and 135 are formed on their outer face with three ribs 141, which in addition to providing stiffening of the plates, serve during rotation of the reel as brakes, since they are immersed in water once the ship sinks, and as the reel is rotated rapidily in the restricted space provided for by skirt 129 by the paying out of cable 143 wound on the reel, these ribs churn the water and provide appreciable braking to offset possible over-ride of cable 143. Suitable ribs may have a depth of 7/16 inches, and a length of 4 inches. In addition, a mechanical, friction type brake acts on the reel also to prevent possible over-ride. The cable 143 is 3,000 feet long and is provided at its free end with anchoring means in the form of a rapid release shackle 145. It has a diameter of 3/32 inch, and is of galvanized steel stranded 7 × 7. Its certified tensile strength is 1,200 pounds.

At least one lifeboat mooring line 123, formed buoyant of polypropylene rope of suitable diameter (preferably 9/16 inches) and 2,200 pounds breaking strength, extends from a strong point 124 mounted on the skirt 129. This line has a length of at least 40 feet, and preferably 50 feet. The line 123 is fleeted and stowed in position as shown in FIG. 10 and is held in place by readily breakable pre-tested 3 pound monofilament cords threaded through neat holes in the side of skirt 129. These holes are sealed against ingress of moisture. The inner end of lift boat mooring line 123 is permanently affixed to the strong point 124 by splice, thimble and shackle. At the outer end of the life boat mooring line is an ample spliced eye to which is attached a lanyard 127 holding a water activated completely self-contained buoyant electric lamp 125. Preferably, the line 123 has several eyes spaced along its length, and may also have floats (not shown) to be more easily seen. The lamp 125 contains a silver-magnesium battery which has an indefinite shelf life and a minimum operating life of 14 hours, and which allows the lamp to produce a steady white light visible for about 3 miles. To activate the important life boat mooring line 123 there is provided 100 feet or less of 50 pound test monofilament rip cord line 128, one end of which is affixed to the eye of the life boat mooring line 123. The intermediate, stowed length of the rip cord is held on a small reel **128*a*, attached by cord 128*b* to a seating mount rail 155 to be described. The reel 128*a* allows the rip cord to be pulled out to its full length at a low tension well below the tension required to pull free the line 123 by breaking the 3 pound pre-tested cords. In action, after the vessel's mast, radar scanners and other possible obstructions have submerged to a safe depth, the 50 pound rip cord 128 pulls the life boat mooring line 123** from its stowed position on the skirt, then it breaks and allows the life boat mooring line to float free ready for its intended purpose of securing buoyant equipment which may have come clear from the sinking ship.

Mounted on the inside of the body are one gallon cannisters indicated at 147, one containing calming oil, and the others containing shark repellent and Fluoresceine dye. These are arranged when the buoy is released from the ship to release the fluids in a controlled manner over a suitable period of time.

The buoy body 101 has a diameter of 24 inches and the buoy has a total weight of 98 pounds. It is mounted on an upper part of the vessel's structure, whre it will not become entangled on release with the vessel rigging, in a buoy seating base 151. Base 151 includes a circular steel or aluminum plate 153 secured to the deck of the vessel either by welding or by a number of bolts. The buoy sits on a neoprene rubber pad on this plate and is held against lateral displacement by a horizontal seating rail 155 which closely encircles the buoy immediately below the lugs 119, this rail being formed by aluminum or suitably galvanized steel pipe and treated against corrosion, and mounted on the plate 153 through four columns 157 also formed of steel or aluminum pipe and welded at their ends to the rail 155 and the plate 153. Possible rattle or vibration is arrested by four vertical neoprene wedges between the buoy and seating base 151.

In vessels plying arctic routes, stainless steel sheeting is installed between the verticals 157. An electric heating element is installed within this enclosed area. The heat rising precludes any risk of the buoy becoming locked in by ice and it is free to leave the seated position under icing conditions. A suitable electric receptacle is installed near the buoy which through weatherproof cording supplies ship's power to the heating element.

In installing the buoy shown in FIGS. 10 and 11, the seating base 151, preferably with the buoy in place, is lifted onto and secured to the deck of the vessel in an area as nearly free from rigging and other obstructions as possible. The shackle 145 is coupled to an eyebolt which is attached to the base plate of the seating mount, a quick release shackle or snap hook being used to make this connection. The buoy is now ready for use. The switches 109 are used for periodic maintenance checks on the buoy, and to trigger the radio transmitter should the vessel become disabled and need help or in the event of vessel power failure with resultant radio silence. In slow sinking, switch 109 may be manually triggered whereby help may arrive even before the vessel has submerged.

Should the vessel sink suddenly, then the buoy will automatically disengage from the seating base 151, the cable 143 paying out from the reel 131. Because of the slanting configuration of the base of the buoy and the way in which the buoy is supported, well below its center height, by the rail 155, the buoy can lift away from the seating base even if the vessel enters the water at a considerable angle to the upright, or capsizes. In most cases, however, there will be sufficient time to launch the buoy, for example by the use of its own davit launching boom, or manually.

As the vessel sinks, outer end of the cable 143, i.e. the part provided with the shackle 145, will sink with the vessel, to which it is attached, and the reel 131 will rotate in its bearings 139. Since the ribs 141 churn the water, they provide a brake on the paying out of the cable, and ensure that the cable 143 pays out in a controlled manner preventing over-run and snarling of the cable. The inner end of the cable 143 is of cource attached to the reel, and when the vessel has settled on the sea bottom, the cable will continue to pay out as the buoy drifts with the survivors in accordance with the prevailing currents and wind, until the cable is fully paid out. The buoy will then remain anchored.

The removal of the buoy from its mount causes operation of the magnetic switch within the buoy which activates the various electrical circuits in the buoy and submersion of lamp 125 causes activation of this lamp. Thus, when the buoy leaves the seating base 151, the strobe light 105 has commenced flashing, the radio transmitter is operative, and a beacon and distress signal is being emitted from the antenna 111. The life boat mooring line 123 is pulled from its fleeted position by rip cord 128 after the full length of this has been pulled off reel 128*a* at low tension at which point the vessel has submerged sufficiently that its superstructure and rigging cannot be caught on the lifeboat mooring line, and when the rip cord breaks the line 123, being buoyant, floats on the surface and away from the buoy, and at the free end of this mooring line the electric lamp 125 commences to emit a steady white light to aid swimmers or those in buoyant equipment in attaching such equipment to lifeboat mooring line 123.

Members of the vessel's crew can swim to the mooring line or the buoy for support, making use of the arm loops 121 or the lugs 119. Ships' boats can come alongside the lifeboat mooring line 123 and make fast one behind the other on the mooring line. It will be seen that in this way all the survivors are kept in a compact group close to the radio and light beacons, and even those boats which initially become separated from the others can "home" on the flashing beacon.

One important difference between the buoy shown in FIGS. 10 and 11 and that shown in the aforesaid patent is that the cable reel is carried by the buoy, rather than being mounted on the ship. This has a considerable practical advantage, in that even if the cable 143 becomes entangled in the rigging of the ship, the cable can still pay out from the reel, so that the vessel may continue to sink without any danger of taking the buoy with it.

The cable length of 3,000 feet is ample for operation of the vessel in coastal waters and over continental shelves. If a vessel is going on a voyage over deeper waters or is operating on and off continental shelf soundings, then part of the normal vessel's procedure would be to uncouple the shackle 145 at the time of entering water of over 500 fathoms or when in doubt as to accurate soundings, so that in the case of shipwreck the buoy would not be secured to the vessel, but remain on the surface and be effective both as a visual and radio beacon, and act as an assembly point for survivors. Also, in these circumstances the buoy with the weight of its cable within it drifts more slowly than other buoyant equipment, thereby providing an effective sea anchor which will hold the buoyant equipment head-to weather.

The buoy shown in FIG. 12 is generally similar to that shown in FIGS. 10 and 11, and similar numerals are used in all these figures to denote similar or corresponding parts. The buoy of FIG. 12 however is designed for use in larger vessels, i.e. vessels of 100 feet length and over, and also has a modified rip cord arrangment for releasing the mooring line. Since larger vessels will normally carry a larger crew and will have more life boats, it is desirable that the cable of the buoy, i.e. the wire rope 143, shall be somewhat heavier, and this leads to a larger cable reel 131 and the need for a larger buoy to support the added weight. Thus the buoy of FIG. 12 has a diameter of 30 inches, and its complete weight is 310 pounds, including the seating mount. The cable has a diameter of 3/16 or ¼ inch, and is galvanized steel. Its certified breaking stength is 4,500 or 9,000 pounds respectively.

The upper part of the body 201 of the buoy has streamlined lugs 119, to which are connected arm loops 121 of wire cored rope as in the embodiment of FIGS. 10 and 11, releasably held onto the buoy body by tapes to prevent entanglement with rigging. In this embodiment the cable reel is enclosed in an open-bottom rectangular housing 205 made out of aluminum sheet with a thickness of 3/16 inch and attached to the buoy body 101 with stainless steel bolts. The ends of housing 205 carry the journal bearings for the reel spindle, and in this embodiment the reel is wholly enclosed in this housing. A further difference of this embodiment is that the ribs 141 attached to the end plates of the reel do not extend to the full diameter of the end plates so that the outer margins of these plates are uninterrupted, and a spring biased friction brake acts against the margin of one plate to provide braking additional to that provided by the ribs 141.

A further difference in this embodiment is the provision of an access door 209 in housing 205, through which the shackle 145, and its point of fixture to the deck, is readily accessible, so that it can easily be disconnected if the vessel is to undertake deep sea crossings or operate on and off continental shelf soundings.

The life boat mooring line of this embodiment is similar to that of the embodiment of FIGS. 10 and 11, except in being at least 50 feet in length. The lifeboat mooring line is also stowed in similar manner as in the last embodiment, being fleeted around part of the reel casing 205 and attached to this by pre-tested readily breakable cords 212. In this embodiment, however, the rip cord is constituted by a length of 200 pound breaking strength flexible stainless steel wire 214 the main stowed length of which is carried by a small reel 215 enclosed within a casing 216 carried by the buoy seating base 151 near to its rim; the reel and casing being shown in more detail in FIG. 13. The inner end of wire 214 is secured to the spindle of reel 215. The wire passes out through a small hole in the top of casing 216, and the outer end of this wire is led behind the cords 212 holding the mooring line, and is then connected to the main part of the wire to form a noose or slip line. At the time of installation, the wire 214, which is supplied as a 100 feet length, is cut off to a length a little greater than the height of the uppermost rigging above the intended location of the buoy. The reel 215 rotates relatively freely so that when the buoy separates from the vessel, the wire can be pulled off at a relatively low tension, until the rip cord wire is fully extended from the reel, at which point the wire will apply sufficient force to the cords 212 to break these and release the lifeboat mooring line 123 from its stowed position. Once the mooring line is released, wind and wave action will cause this to stream out downwind from the buoy, ready to be grasped by swimmers or used as a mooring line by life boats and other boyant equipment.

The arrangement just described is generally preferred to that described with reference to FIGS. 10 and 11, in that with this arrangement complete separation of the mooring line occurs even if the vessel only sinks by an amount slightly greater than the rip cord length. In the previous embodiment, full release only occurs when the vessel has sunk by an amount equivalent to the combined length of the rip cord and mooring line.

Figure 13:
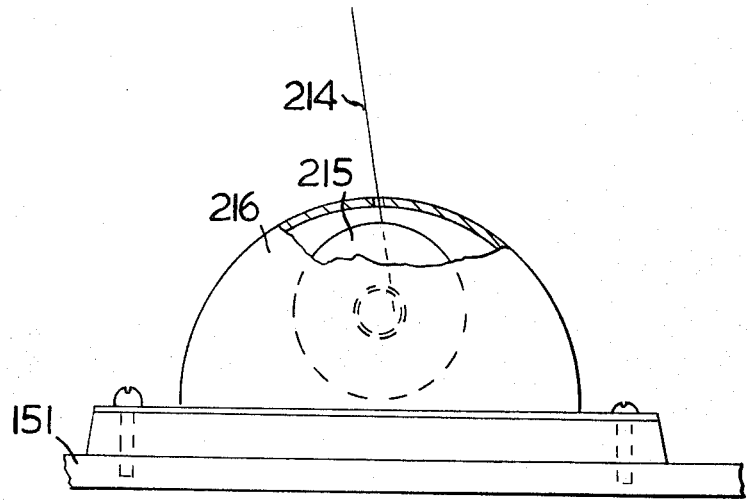
FIG. 13 is an enlarged view of a component of the arrangement shown in FIG. 12.
Figure 14:
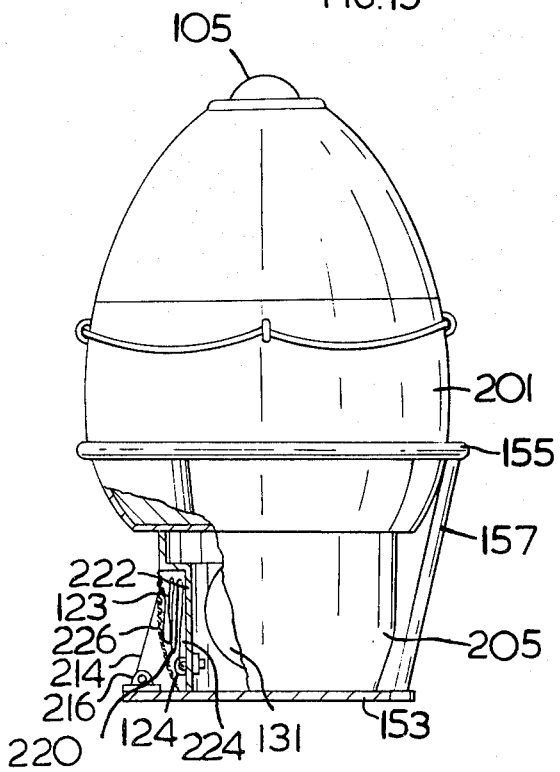
FIG. 14 is a perspective drawing of a modified form of the embodiment shown in FIG. 13.

FIG. 14 shows an embodiment which is very similar to that of FIGS. 12 and 13, but differs in that the lower sides of the reel casing converge inwardly, and the lifeboat mooring line 123 is normally stowed in an enclosure 220, this enclosure being formed on the buoy and being sealed against the weather to protect the mooring line from the effects of the weathr and from damage. The enclosure 220 is formed by a shallow recess on the reel casing 205 formed by a rear wall 222, and two outwardly sloping side walls one of which is shown at 224. The outer wall of the enclosure, which is continuous with a side of casing 205, is formed by a fabric or plastic cover 226. The bottom of the recess is normally closed by the seating base 151, although otherwise open. The mooring line 123 is loosely fleeted and stowed in this enclosure, having its inner end fixed to a secure anchorage point in the enclosure.

To the upper end of fabric cover 226 is attached by suitable reinforcement a rip cord constituted by a stainless steel wire 214 similar to that described above with reference to FIGS. 12 and 13, and carried by a similar reel 215 again mounted in a casing 216 attached to seating base 151. The arrangement is such that when the stowed length of rip cord 214 has been pulled from the reel 215, after separation of the buoy from the vessel by a predetermined amount, the rip cord exerts sufficient tension to rip open the fabric or plastic cover 226 so that the lifeboat mooring line 123 is then exposed to the action of water in which the buoy is floating. The positioning of the recess in the reel casing, and the shape of the recess with its outwardly sloping side walls 224, and the open bottom thereof, all ensure that the lifeboat mooring line is quickly dislodged from the recess by the action of the water so as to stream out on the water.

Instead of the recess for the lifeboat mooring line being provided in the reel housing, this may be positioned in part of the buoy body 201.

Figure 15:
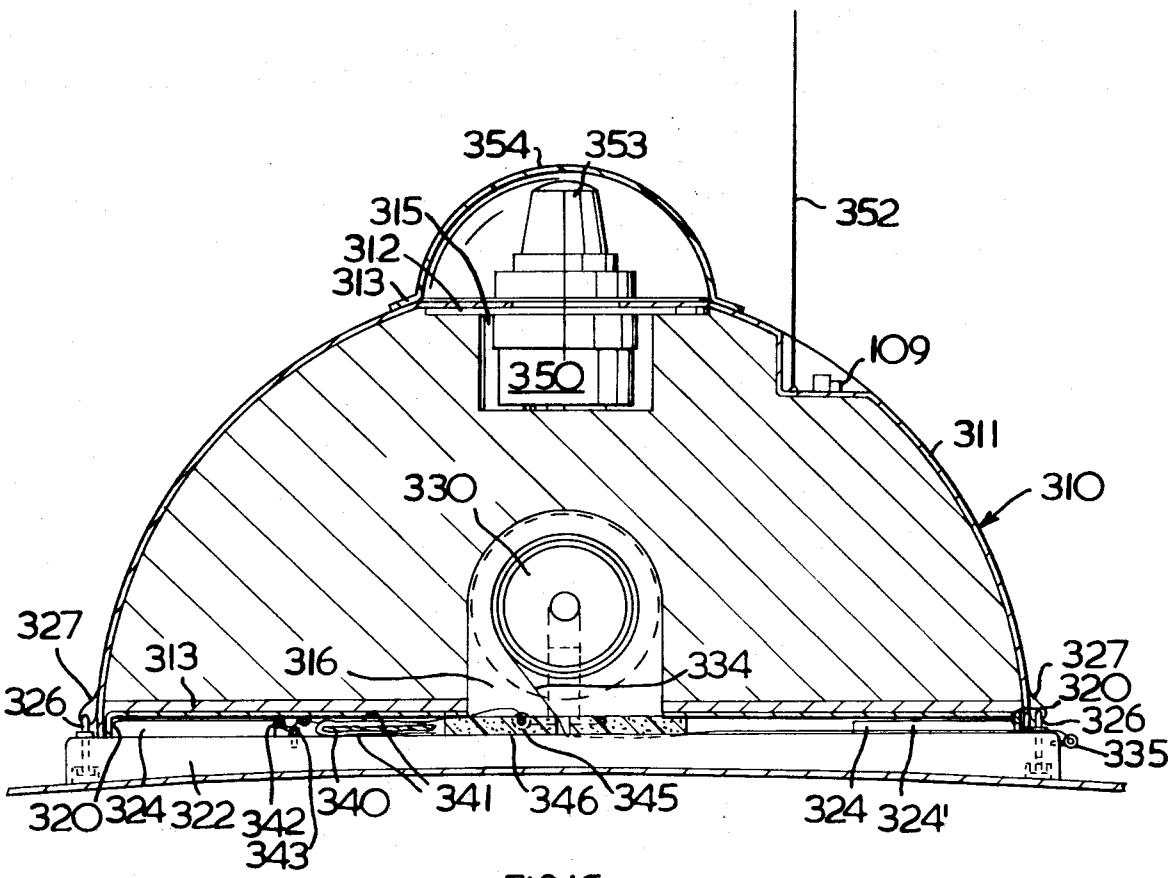
FIG. 15 is a sectional elevation of a fourth embodiment of the invention.
Figure 17:
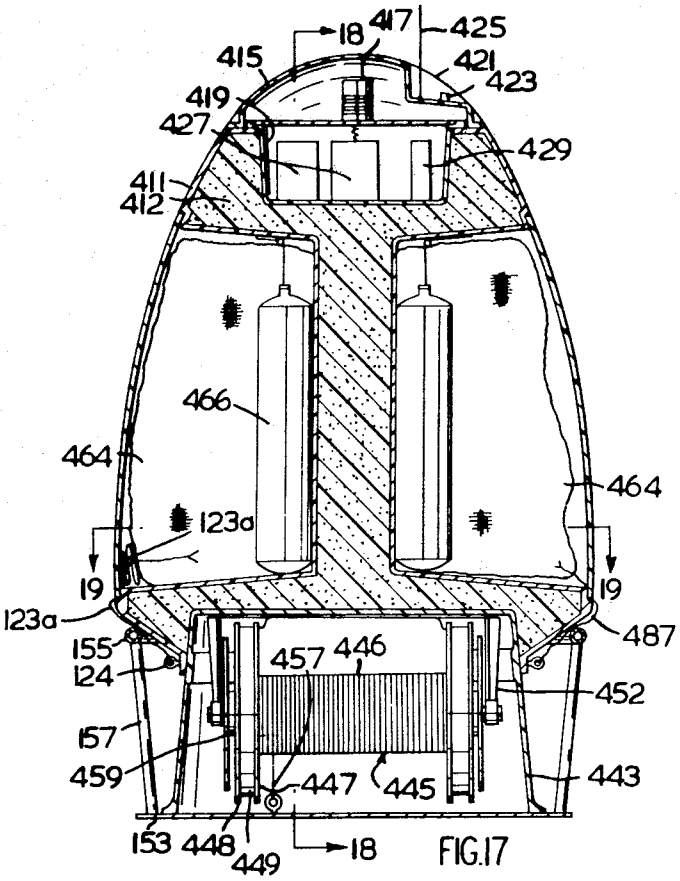
FIG. 17 is a sectional elevation on line 17—17 of FIG. 16.
Figure 16:
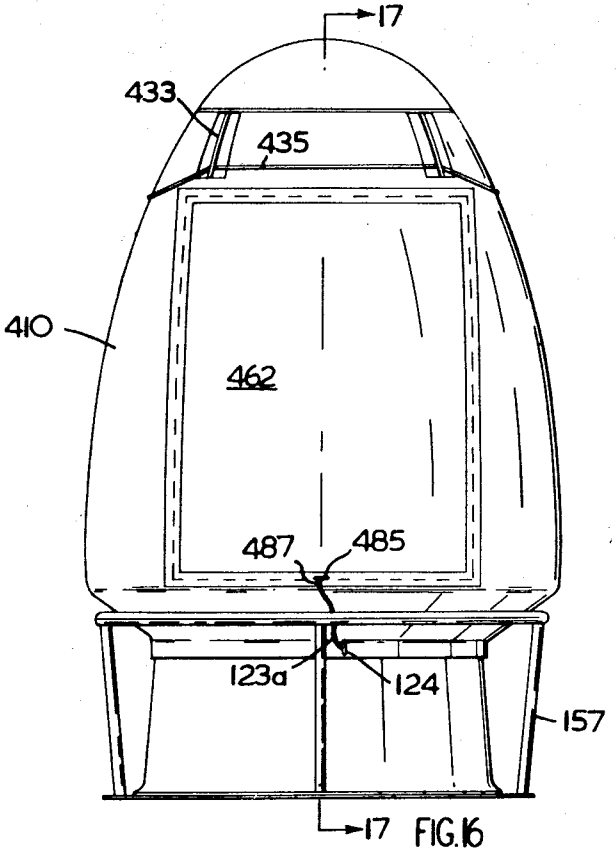
FIG. 16 is a side view of a fifth embodiment of the invention.

In a further embodiment of the buoy, shown in FIG. 15, the mooring line 123 is stowed in an enclosure formed between the base of the buoy and the support for the buoy. This buoy is the smallest of the buoys described herein, having a height of about 15 inches, and a diameter of 24 inches and is intended for small vessels such as yachts.

The buoy as shown in FIG. 15 is similar to that of FIGS. 10 and 11 in including a body 310 having a casing 311 of glass fiber reinforced plastics which encloses a filling of closed-pore foamed synthetic material 312. A metal plate 313 in the base of the buoy provides ballast. The top of the body is centrally recessed at 315, to accommodate a light beacon and radio transmitter as will be described in more detail. Also the base of the body is centrally recessed at 316 to accommodate cable reel 330 carrying an anchoring cable 334 which is led outside the buoy and secured to a mounting pad 322 by eye bolt 335 near the edge of the pad. The body, near to the top of the buoy, is provided with a series of eyes spaced around the buoy and which hold arm loops of polypropylene line (not shown).

The base of the body is provided with a short skirt 320 extending down from the perimeter of the casing 311. This skirt is arranged to cooperate with a flat support surface on the upper side of a mounting pad 322 to provide a narrow enclosed space under the base of the buoy. The mounting pad 322 has a lower surface curved to lie on a curved deck of a vessel. Four blocks 324 are provided spaced around the pad 322 and which locate against the inside of the skirt 320 to located the buoy in position. Four eye bolts 326 are provided spaced around the outer margin of the pad 322, outside the skirt 320, and these serve to hold the ends of two cords 327 which are affixed to the eyes which hold the arm loops described above. These and the block 324 normally hold the buoy in place on the pad 322 which is itself securely fixed to the deck. The cords 327 are pre-tested lines arranged to break at a pre-tested tension of about ten pounds so that if the vessel sinks the buoy will break free from the cords and remain on the surface. The cords are sufficiently strong to prevent the buoy from being dislodged by wind or by water sweeping over the deck.

The lifeboat mooring line used with the buoy of this invention is a 25 foot length of 3/8 inch thick polypropylene line 340 which is normally fleeted in the enclosed space between the buoy and the pad 322, this line being buoyant and being of adequate strength for mooring of a boat or life-raft thereto. The fleeted line is normally held close to the base of the buoy by readily breakable cords 341, pre-tested to break at 5 pounds tension. A rip cord 342 is provided having an outer end looped around the cords 341 holding the lifeboat mooring line, and having a stowed length of say 50 feet formed into coils 342 also held by readily breakable cords 341 to the buoy base with the lifeboat mooring line. The inner end of the rip cord is attached to eye 343 carried by pad 322.

The outer end of the lifeboat mooring line is provided with an eye and a light similar to those described with reference to FIG. 10. The inner end of the lifeboat mooring line is connected via a stainless steel wire tag line to a stainless steel ring 345 which surrounds the cable 334 at a point near to the reel. The ring 345 is embedded in a buoyant pad 346 having a hole through which the anchoring cable 334 passes, this pad 346 also being accommodated in the space between the buoy and the pad 322, and having its outer periphery secured to the base of the buoy. The buoyancy of this pad 346 is such as to hold the ring 345 close to the bottom of the buoy if, after the buoy has been released from the vessel, the stress on line 340 should cause the pad to break away from the buoy. The anchoring cable 334 is free to move through the ring 345 and pad 346 while deploying. Thus, the lifeboat mooring line in operation may be effectively anchored by the cable 334, (if pad 346 breaks free of the buoy) and the buoy itself may be made of very light construction without any danger of damage being caused by strong tension on the lifeboat mooring line.

The buoy also includes signalling means which operate automatically to send out a distress signal and to assist in location of the survivors. These are provided by an electronics cannister 350 contained in recess 315, and which carries a radio transmitter connected to antenna 352, a strobe light 353 covered by a clear Lucite dome 354, which seals against the casing 311 to prevent ingress of moisture into the dome or into recess 315. The light 353 is connected to a solid state driving circuit within the cannister 350. Cannister 350 also contains batteries for the light and radio. The characteristics of the light and radio transmitter are similar to those described for the previous embodiments, and may be operated manually by switches 109 or automatically for example by magnetic switch means when the buoy separates from the pad 322.

In operation, if the vessel gets into distress, the buoy can easily be launched by releasing the cords 327, the buoy being light enough to be easily lifted and thrown over the side.

Should the vessel sink suddenly, however, immersion or partial immersion of the buoy will cause the cords 327 to break and thus release the buoy, allowing this to remain on the surface of the water as the vessel sinks. The stowed coils 342 of rip cords 342 are pulled away from the buoy base as the inner end of the rip cord is pulled away from the buoy by the eye 343, and when fully extended the rip cord breaks the readily breakable holding cords 341, releasing the lifeboat mooring line 340 and allowing this to gradually spread out due to movement of the buoy in the water, and to stream out down-wind of the buoy. The inner end of lifeboat mooring line 340 is held in position by ring 345 as described. This mooring line preferably has eyes providing convenient mooring points for any life-rafts, dinghies etc. which have been released or floated free of the vessel. Swimmers can also grab the mooring line, or the arm loops on the buoy. The separation of the buoy from the pad 322 also energizes both the radio transmitter and strobe light 353, which then commence to send out distress and homing signals.

FIGS. 16 to 19 show a further embodiment of the invention in which the lifeboat mooring line is normally stowed in an enclosure formed by a recess in the buoy normally closed by a cover. In this case, however, the enclosure also houses an inflatable life raft, the life raft and mooring line being released at the same time. This embodiment of buoy is described in detail in my co-pending Patent application Ser. No. 471,964 filed May 21, 1974, to which reference may be made for certain details which are not of importance in this application.

The embodiment shown in FIGS. 16 to 19 is generally similar to that shown in FIG. 12, although somewhat larger in external dimensions. The overall height of this buoy is 53 inches. As before, the buoy has a main body 410 with an outer casing 411 of glass fiber reinforced plastics, filled with closed pore synthetic foam material 412. The buoy also includes a Lucite dome 415 covering a strobe light 417 held in cannister 419. The upper part of the dome 415 has a recess 421 in which are disposed control swiches 423 and the base mounting of antenna 425. Inside the cannister 419 are batteries 427 for operating the strobe light and a sealed container 429 housing a solid state driving circuit for the strobe light and a radio transmitter, all described in more detail in co-pending application Ser. No. 471,964.

Spaced round the periphery of body 1 are four streamline cast aluminum or stainless steel lifting lugs 433 securely fixed to backing-plates within the body 1. These lugs are used for the moving or launching of buoy. A looped, wire cored polypropylene lifeline 435 is installed between lugs 23.

Attached to the bottom of the body 410 is a generally cylindrical, but slightly downwardly diverging housing 443. The lower end of housing 443 is normally closed by resting on support plate 153, and the buoy is held in position by support rails 155 carried by columns 157, as previously described with reference to FIGS. 10 and 11. This housing 443 serves as a casing for a cable reel 445 comprising a spindle 446 having at each end a pair of plates 447 and 448, and being carried by journal bearings at the ends of support members 452. The end plates 447 and 448 carry in the space between them a series of paddles or vanes 449 which, in addition to providing stiffening of the plates, serve during rotation of the reel as brakes, since they are immersed in water once the vessel sinks, and as the reel is rotated rapidly in the restricted space of housing 443 by the paying out of anchor cable 457 wound on the reel, these paddles churn the water and provide appreciable braking to offset possible over-ride of the cable. A mechanical friction brake is also provided. Spindle 446 extends beyond the outer plates 448 to provide small reels 459 serving a purpose to be described.

Figure 19:
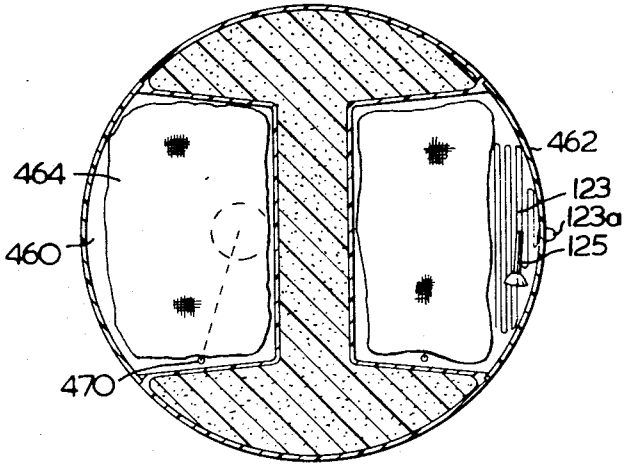
FIG. 19 is a cross section on line 19—19 of FIG. 17.

The body 410 has two recesses 460 disposed in opposite sides thereof, these recesses occupying sightly more than half the cross-sectional area of the buoy, as shown in FIG. 19. The recesses are closed by covers or doors 462, the edges of which fit into rebates around the recesses, the covers being curved to conform with the body shape, and being held in place with sealing tape around the periphery of the recess in such manner as to prevent ingress of moisture, while allowing the covers to be forced off in a manner to be described. Each recess accommodates an inflatable life raft 464 arranged to be inflated by pressurized gas (carbon dioxide) contained in a cylinder 466 which forms a part of the life raft. Further details concerning the life raft are given in co-pending application Ser. No. 471,964.

The pressurized gas with each cylinder 466 is releasable into the associated life raft by valve means (not shown) operated by a predetermined tension applied to a pull cable 470 led over pulleys 471 and 472. The outer end of cable 470 carries a small travelling reel on a covered slide 474 fitted into an enclosed track indicated at 476 allowing vertical movement of the reel without interference with the life raft. The reel and slide 474 carries a release line constituted by a 100 foot length of stainless steel cable 478 having one end secured to reel 474 and its main length wound on this reel. The outer end portion of line 478 is led down via pulley 479 and a conduit 480 connecting the base of each recess 460 to the interior of reel housing 443, and finally secured to one of the small reels 459 on the ends of the main cable reel 446. The release line 478 is provided with a weak link 482 near to that inner end attached to the reel 474, and arranged to break at a tension substantially greater than the predetermined tension required to be applied by cable 470 to operate the valve means of cylinder 466 as the reel and slide move down in the tracks.

The lifeboat mooring line 123 of this embodiment is a 200 foot length of polypropylene with a water activated light at its outer end, and eyes and floats spaced along its length as in previous embodiments. This line is loosely fleeted and stowed in the bottom of one of the recesses 460, being thus enclosed and protected from weather, and the inner end of this line, which is constituted by a stainless steel tagline **123*a* passes out of the base of cover 462 at 485 and is fixed to eye bolt 124** which also holds one of the life raft painters.

Operation of this embodiment is in many respects similar to that of previously described embodiments. If a vessel carrying the buoy sinks suddenly, the buoy floats away from the mounting provided by rail 155, this movement causing operation of a magnetic switch within the buoy which activates the strobe light 417 and the radio transmitter.

The buoy remains connected to the vessel by anchor cable 457, which pays out from reel 445 causing this to rotate. Overrunning is prevented by the friction brake and by paddles 449 churning the water and acting as a brake. The small reels 459 rotate with reel 445 and cause the release lines 478 to be pulled off the travelling reels 474, these latter reels being freely rotatable so that little tension is applied to the pull cables 470. After the vessel has sunk by an appropriate depth (depending on the relative diameters of reels 445 and 459), all the stowed length of release lines has been pulled off the reels 474, although the ends of the release lines remain attached to reels 474. Thus, further rotation of reels 459 causes the travelling reels 474 and slides to move downwards in tracks 476, pulling cables 470 over pulleys 471 and 472 and releasing the pressurized gas in cylinders 466 into the inflatable life rafts 464. The release lines then break at the weak links so as not to interfere with further rotation of the anchoring cable reel. The life rafts then start to inflate, and in doing so dislodge the covers 462 which sink. Subsequently the life rafts expel themselves from their recesses 460 into the water and fully inflate. The life rafts remain connected to the buoy by painters and wire taglines 487. The deployment of the life rafts in this manner causes the lifeboat mooring line 123 to first be dislodged, and this then streams on the water while remaining attached to the buoy via the tag line by eye bolt 124.

It will be apparent from the above that the main and auxiliary reels 445 and 459, taken together with anchoring cable 457 and the release line 478, and reel 474, and cable 470 provide a delayed action connecting means interconnecting the buoy and the vessel in such manner as to inflate the life raft only when the buoy has separated from the vessel by a predetermined amount to be decided upon when the buoy is installed on the vessel in accordance with the top hamper. These parts taken together with the cylinder 466 and the life raft 464 provide means for automatically opening the cover of the enclosure holding the lifeboat mooring line 123 in the same delayed manner.

In certain circumstances, for example in deep sea operations or while operating on and off continental shelf soundings the anchor cable is disconnected to prevent the buoy from being dragged down with the vessel, or where the vessel sinks in very shallow water, the automatic delayed action mechanism described above will not work. Accordingly a manually operable release mechanism, indicated at 490 is provided and this allows that a direct pull may be applied by survivors to cable 470 from outside the buoy be they on the deck of a ship, in bouyant equipment or swimming in the water.

Figure 18:
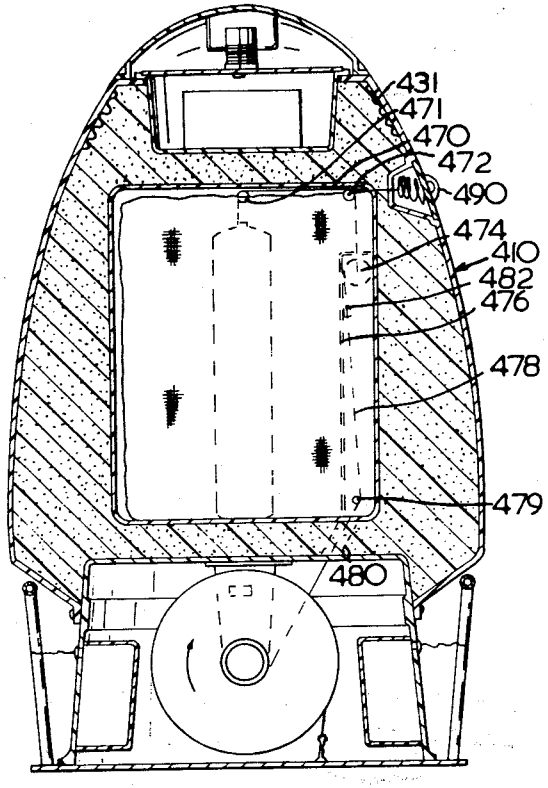
FIG. 18 is a sectional elevation on line 18—18 of FIG. 17.

Instead of the self-contained delayed action mechanism described in the foregoing using auxillary reels 459 being part of the main reel 445, the release line 478 may be directly connected to an eye on the buoy support plate 151, FIG. 18. In every case however, it is necessary to provide a release line of a length determined by the separation distance required between the vessel and the buoy to effectively govern the moment at which time the lifeboat mooring line and the life rafts will be released. This is accomplished at the time of installation of the buoy on the ship and the total height of her rigging and top hamper is known. The release line is then adjusted to suit, from the standard 100 foot length supplied with the buoys.

The embodiments of the invention in which an exclusive property or privilege is claimed are defined as follows:

1. In an anchoring device for buoyant equipment comprising a buoy suitable for being carried by a vessel in a manner permitting release and flotation of the buoy should the vessel sink, said buoy including sufficient buoyancy to cause the buoy and parts carried thereby to float free from the sinking vessel, a cable normally stowed in a manner allowing said cable to be pulled out to its full length, said cable being of adequate strength to act as an anchor cable, said cable being connected with the buoy and for connection with the vessel so as to maintain connection between the floating buoy and the vessel after the vessel has sunk: the improvement comprising a buoyant lifeboat mooring line of adequate strength to hold a life raft or boat in position relative to the buoy, said mooring line being permanently secured at one end to the buoy and being at least several times greater in length than the largest dimension of the buoy, said mooring line being normally stowed with the buoy in such manner as to be released automatically from the stowed position when the buoy separates from the vessel to permit said line to stream out in the water, whereby if the vessel sinks the buoy is released and remains on the surface of the water and said mooring line is released from said stowed position and streams out on the water to provide securement for buoyant equipment to hold this in position relative to the buoy.

2. An anchoring device according to claim 1, wherein means are provided for releasing said lifeboat mooring line on separation of the buoy from the vessel, said latter means including a rip cord for connection to said vessel and operable to release the mooring line.

3. An anchoring device according to claim 2, wherein said rip cord for connection to the vessel has a length of at least 50 feet.

4. An anchoring device according to claim 1, wherein said mooring line is held in stowed position by holding means, and wherein there is provided means interconnecting the buoy and the vessel and comprising normally stowed release means which cause release of said holding means when the release means are pulled out to their full length, said release means being arranged to be pulled from a stowed position when the buoy separates from the vessel and having a stowed length sufficient to allow the vessel to sink until its rigging is submerged before the release means is pulled out to its full length to release the lifeboat mooring line.

5. An anchoring device according to claim 4, wherein said holding means includes breakable cord means normally holding the mooring line in stowed position, and wherein said release means is a rip cord arranged to break said breakable cord means when fully extended.

6. An anchoring device according to claim 5, wherein said rip cord is arranged to contact said breakable cord means when fully extended to cause breakage thereof.

7. An anchoring device according to claim 2, wherein said rip cord is stowed on the vessel by means permitting the rip cord to be pulled out to its full length at a relatively low tension, said tension being less than that required to be applied to the rip cord to release the lifeboat mooring line.

8. An anchoring device according to claim 7, wherein said rip cord is carried by a reel on the vessel.

9. An anchoring device according to claim 1, wherein said mooring line is normally stowed in an enclosure formed at least partly by the buoy, said enclosure being substantially sealed against water, said mooring line being permanently secured at said one end to the buoy so as to remain secured thereto both when in said enclosure and after release therefrom.

10. An anchoring device according to claim 9, wherein said enclosure is formed by a recess on the buoy normally closed by a cover, and wherein means are provided for automatically opening said cover and releasing said mooring line when the buoy has separated from the vessel by a predetermined amount, whereby said mooring line is caused to stream out on the water.

11. An anchoring device according to claim 10, wherein said cover is formed of a tearable material, and wherein said means for automatically opening said cover include delayed action connecting means providing interconnection between said buoy and the vessel, said connecting means including a rip cord connected to said material in such manner as to rip open said cover when the rip cord is subjected to predetermined tension, said rip cord having a substantial length thereof normally stowed on the vessel and releasable therefrom at a tension less than said predetermined tension when the buoy separates from the vessel so that said cover is opened to release said lifeboat mooring line only when the buoy has separated from the vessel by a predetermined amount.

12. An anchoring device according to claim 1, wherein said buoy is provided with an enclosure formed by a recess in the buoy, said recess being substantially sealed against water by a cover, said recess accommodating said lifeboat mooring line which is secured at said one end to an anchorage point, on said buoy so as to remain secured thereto both when in said recess and after release therefrom, the device including a reel carried by the vessel near to the base of the buoy and a rip cord normally coiled on the reel and having an inner end secured to the reel and an outer end fixed to the cover, in such manner as to rip open the cover when the rip cord is subjected to a predetermined tension below its breaking tension, said reel being rotatable to allow the rip cord to be pulled out therefrom at a tension less than said predetermined tension, whereby opening of the cover is delayed until the rip cord has been pulled out to its full length, said rip cord having a length of at least 50 feet.

13. An anchoring device according to claim 9, wherein said enclosure is formed between the base of the buoy and a support on which the buoy rests.

14. An anchoring device according to claim 10, wherein said means for automatically opening said cover include a release line connected to an auxiliary reel on said buoy, said auxiliary reel being connected for rotation with said cable reel, said release line extending from said auxiliary reel to a cover actuating mechanism operable to remove said cover when the release line is subjected to predetermined tension, and said release line having a predetermined length stowed between said mechanism and said auxiliary reel in such manner that on rotation of said auxiliary reel by said cable reel said predetermined stowed length of release line is wound upon the auxiliary reel at a tension less than said predetermined tension, whereby said auxiliary reel subjects the release line to said predetermined tension only after said stowed length has been received on the auxiliary reel whereby operation of said means for releasing the cover is delayed.

15. An anchoring device according to claim 14, wherein said enclosure, in addition to housing said mooring line, also houses an inflatable life raft provided with a source of pressurized gas for inflation, and wherein said cover is normally sealed around the periphery of said enclosure but is arranged to be dislodged by said inflatable life raft on inflation thereof, and wherein said cover actuating mechanism includes valve means for releasing said pressurized gas from said source to allow the gas to inflate the life raft and thereby cause dislodgment of the cover.

16. An anchoring device according to claim 10, wherein said enclosure, in addition to housing said mooring line, also houses an inflatable life raft provided with a source of pressurized gas for inflation, and wherein said cover is normally sealed around the periphery of said enclosure but is arranged to be dislodged by said life raft on inflation thereof, wherein said means for automatically opening said cover include valve means for said source of pressurized gas and delayed action connecting means providing interconnection between said buoy and the vessel, said connecting means including a release line connected to said valve means to release said pressurized gas from said source to allow said gas to inflate the life raft and thereby to dislodge the cover when said release line is subjected to a predetermined tension, said release line having a normally stowed length which is releasable at a tension less than said predetermined tension when the buoy separates from the vessel so that said pressurized gas is released to cause dislodgement of said cover and release of said inflatable life raft and lifeboat mooring line only when the buoy has separated from the vessel by a predetermined amount.

17. An anchoring device according to claim 1, wherein the inner end of said mooring line is securely fixed to the lower part of the buoy.

18. An anchoring device according to claim 1, wherein said mooring line is at least 25 feet long.

19. An anchoring device according to claim 1, wherein said mooring line is at least 50 feet long.

20. An anchoring device according to claim 18, wherein said mooring line is of polypropylene of at least three-eighths inch diameter.

21. An anchoring device according to claim 1, wherein said mooring line has floats attached thereto and spaced along its length.

22. An anchoring device according to claim 1, wherein the outer end of said mooring line carries a light automatically activated on immersion in water.

23. An anchoring device according to claim 1, wherein said mooring line has several eyes spaced along its length.

24. An anchoring device according to claim 9, wherein said enclosure is formed by a recess on the buoy normally closed by a cover, and wherein means are provided for automatically opening said cover when the buoy has separated from the vessel by a predetermined amount.

25. In an anchoring device for buoyant equipment comprising a buoy suitable for being carried by a vessel in a manner permitting release and flotation of the buoy should the vessel sink, said buoy including sufficient buoyancy to cause the buoy and parts carried thereby to float free from the sinking vessel, a cable normally stowed in a manner allowing said cable to be pulled out to its full length, said cable being of adequate strength to act as an anchor cable, said cable being connected with the buoy and for connection with the vessel so as to maintain connection between the floating buoy and the vessel after the vessel has sunk: the improvement comprising a buoyant lifeboat mooring line of adequate strength to hold a life raft or boat in position relative to the buoy, said mooring line being at least several times greater in length than the largest dimension of the buoy and being normally stowed in an enclosure formed by a recess on the buoy normally closed and sealed against water by a cover of flexible material, and wherein there are provided delayed action connecting means providing interconnection between the buoy and the vessel and arranged for automatically opening the cover to release the mooring line after the buoy has separated from the vessel by a predetermined amount, said connecting means including a rip cord connected to said flexible material in such manner as to rip open said cover by ripping the flexible material away from the recess when the rip cord is subjected to predetermined tension, said rip cord having a substantial length thereof normally stowed on the vessel and releasable therefrom at a tension less than said predetermined tension when the buoy separates from the vessel, whereby if the vessel sinks the buoy is released and remains on the surface of the water and said mooring line is released from said stowed position after the buoy has separated from the vessel by said predetermined amount and streams out on the water to provide securement for buoyant equipment to hold this in position relative to the buoy.

26. An anchoring device according to claim 25, wherein said rip cord is carried by a reel on the vessel.

* * * * *